US006157348A

United States Patent [19]

Openlander

[11] Patent Number: 6,157,348

[45] Date of Patent: Dec. 5, 2000

[54] LOW PROFILE ANTENNA

[75] Inventor: Wayne R. Openlander, Glendale, Ill.

[73] Assignee: Antenex, Inc., Glendale, Ill.

[21] Appl. No.: 09/244,365

[22] Filed: Feb. 4, 1999

Related U.S. Application Data

[60] Provisional application No. 60/073,610, Feb. 4, 1998.

[51] Int. Cl.[7] ..... H01Q 1/48; H01Q 1/38

[52] U.S. Cl. ..... 343/846; 343/700 MS; 343/830

[58] Field of Search ..... 343/700 MS, 846, 343/830, 829, 848, 872; H01Q 1/48, 1/38

[56] References Cited

U.S. PATENT DOCUMENTS

| | | | |
|---|---|---|---|
| 3,414,903 | 12/1968 | Bartlett et al. | 343/753 |
| 4,051,480 | 9/1977 | Reggia et al. | 343/705 |
| 4,160,976 | 7/1979 | Conroy | 343/700 |
| 4,445,122 | 4/1984 | Pues | 343/700 |
| 4,835,538 | 5/1989 | McKenna et al. | 343/700 |
| 5,041,838 | 8/1991 | Liimatainen et al. | 343/700 |
| 5,245,745 | 9/1993 | Jansen et al. | 343/700 MS |
| 5,291,210 | 3/1994 | Nakase | 343/700 MS |
| 5,410,322 | 4/1995 | Sonoda | 343/700 MS |
| 5,410,323 | 4/1995 | Kuroda | 343/700 MS |

OTHER PUBLICATIONS

Capacitive Matching of Microstrip Patch Antennas—Alexander.

Mobile Antenna Systems Handbook—Fujimoto, James.

Small Antennas—Fujimoto, Henderson, Hirasawa, James.

Experimental Results with Mobile Antennas —Kuboyama, Tanaka, Sato, Fujimoto.

*Primary Examiner*—Hoanganh Le

*Attorney, Agent, or Firm*—Daniel M. Cislo; Andrew S. Jordan; Cislo & Thomas LLP

[57] ABSTRACT

A low-profile antenna has increased broad-banding capacities as well as a lower radiation angle for enhanced cellular or mobile telephone wireless transmissions. Enhancing a basic PIFA antenna, a top metal radiator is notched so as to provide additional corners and greater perimeter length thereby enhancing the bandwidth capabilities of the antenna. Both ground and tuning tabs serve to enhance operational characteristics and a dielectric cover incorporating prismatic qualities serves to lower the radiation angle of transmission from approximately forty degrees (40°) to twenty degrees (20°). The prisms provide an operating radiation angle in the range of approximately seventy degrees (70°) to twenty degrees (20°). In one embodiment, a sheet of plastic foam slightly thicker than the depth of an associated connector is secured to the underside of the bottom plate to act as a friction seal when the antenna is screwed onto a mating connector, allowing for slight variations in the curvature of the mounting surface. By making the bottom conductive plate only slightly larger than the top radiator, the antenna's resonant frequency becomes independent of ground plane mounting and may not require such a ground plane. Under such circumstances, some adjustment of the tuning parameters may be required in order to provide optimum response.

20 Claims, 3 Drawing Sheets

FIG. 3
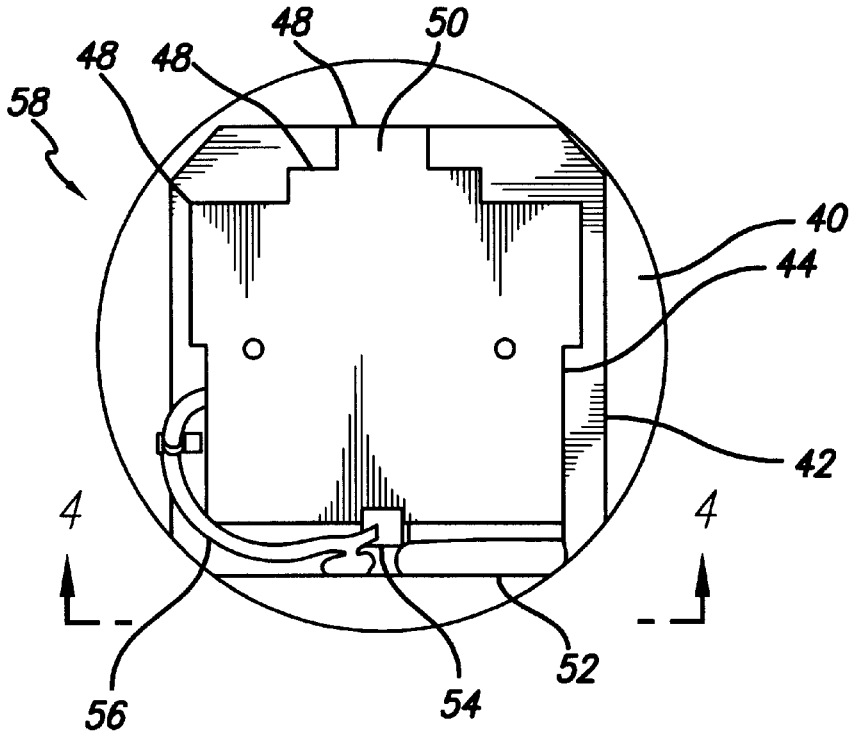
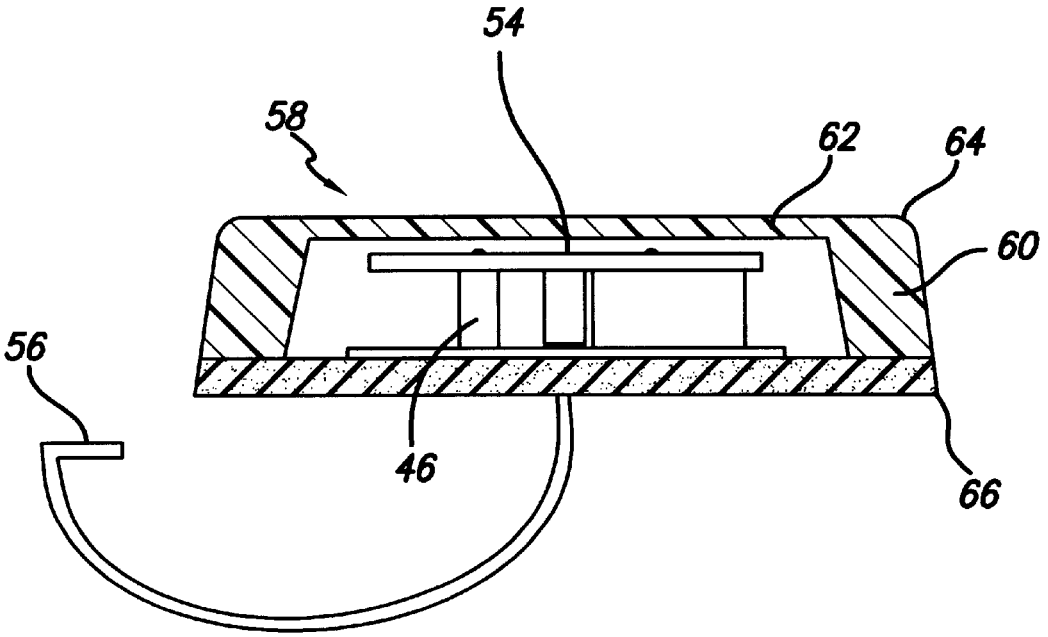
FIG. 4

FIG. 5
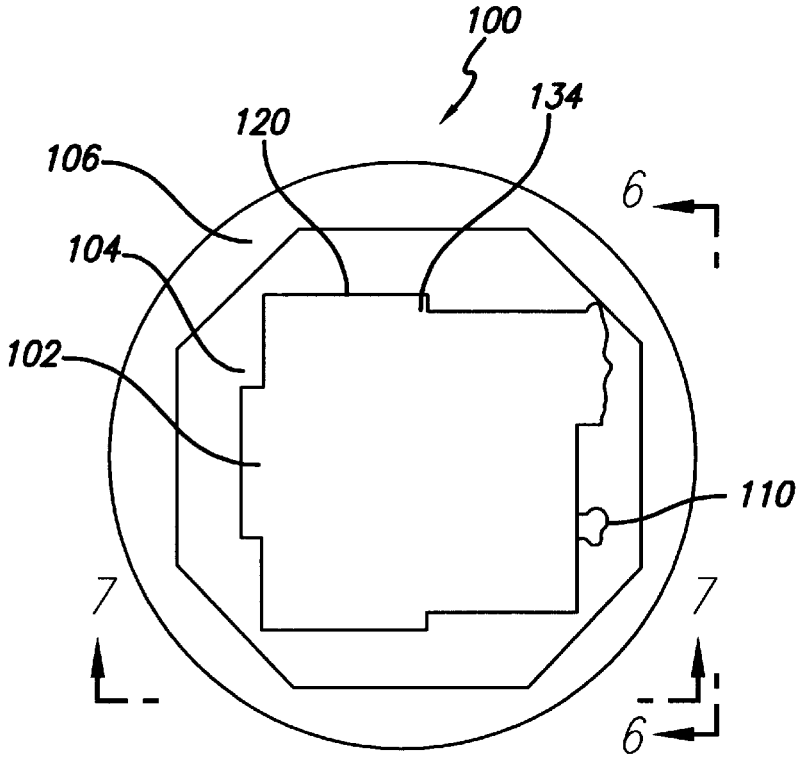
FIG. 6
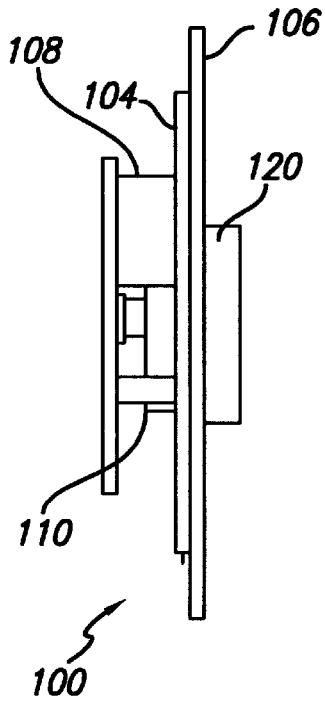
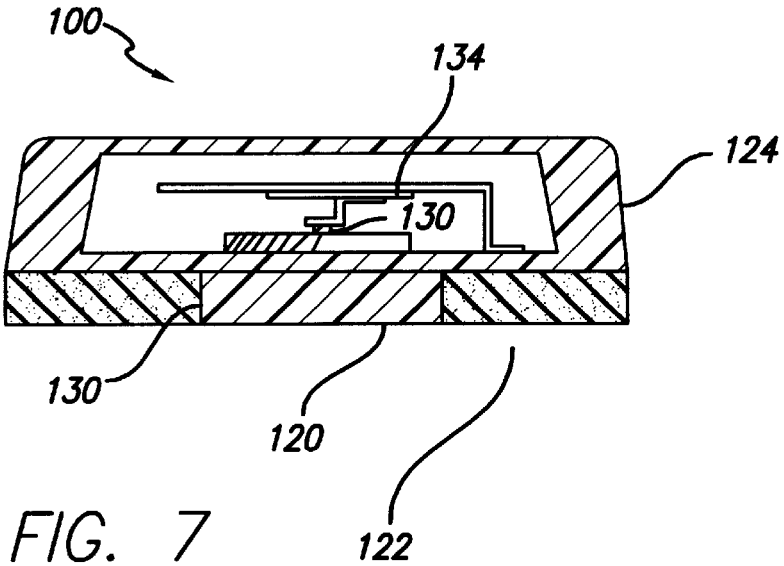
FIG. 7

LOW PROFILE ANTENNA

CROSS-REFERENCES TO RELATED APPLICATIONS

This application is a continuation of U.S. provisional patent application Ser. No. 60/073,610 filed Feb. 4, 1998. Said provisional patent application is incorporated herein by this reference hereto.

BACKGROUND OF THE INVENTION

1. Field of the Invention

This invention relates to antennae for wireless signal transmission, and more particularly to a low profile cellular antenna design meant for facilitating cellular telephone communications in an inconspicuous manner.

2. Description of the Related Art

Generally, disk or patch antennae have a circular disk or rectangular patch configuration and are elevated above a larger ground plane. The transmission line is connected to the center for the circular disk and at an edge or corner for the rectangular patch to serve as the signal feed. Dielectric material is used to support the elevated portion of the antenna above the ground plane.

These antennae are often, but not always, made using printed circuit board materials and techniques. When used in mobile radio applications, the bottom ground plane disk is made the same size as the upper disk and must be mounted against the metal body of the vehicle. Such disk antennae can be made with major dimensions on the order of one-fifth (⅕) wavelength with a spacing between the top element and the ground element on the order of point zero four (0.04) to point one zero (0.10) wavelength.

The major difficulties with such antennae are:

1) a relatively narrow bandwidth on the order of two percent (2%) to three percent (3%) of the center frequency. Wireless telephone applications generally require bandwidths more on the order of seven percent (7%) to ten percent (10%);
2) a feed geometry that is difficult to adapt for mobile radio applications where the antenna must be mounted to the vehicle with a standardized connector system;
3) A high radiation angle, on the order of sixty degrees (60°) to ninety degrees (90°) above the horizon when they are mounted on a horizontal surface of an automobile or other vehicle; and
4) various manufacturing and fabrication difficulties. The positions of hidden posts must be carefully located.

The operating bandwidth of disk antennae may be increased in one of four known and different ways:

1) Adding radiating surfaces and increasing the volume of the antenna as shown in the McKenna et al. '538 patent (U.S. Pat. No. 4,835,538 issued to McKenna et al. on May 30, 1989 for a Three Resonator Parasitically Coupled Microstrip Antenna Array Element);
2) Adding an impedance compensating network as shown in the Pues '122 patent (U.S. Pat. No. 4,445,122 issued to Pues on Apr. 24, 1984 for a Broad-Band Microstrip Antenna);
3) Placing selected impedances into the radiating surface. For example, such impedances may be in the form of inductive posts as shown in the Reggia et al. '480 patent (U.S. Pat. No. 4,051,480 issued to Reggia et al. on Sep. 27, 1977 for Conformal Edge Slot Radiators), or in the form of irregularities in the radiating surface (a ninety degree (90°) radial extension of the disk) as shown in the Conroy '976 patent (U.S. Pat. No. 4,160,976 issued to Conroy on Jul. 10, 1979 for a Broadband Microstrip Disc Antenna); and
4) introducing resistances into the radiating surface and thus lower the Q of the antenna.

In order to improve the radiation angle, making it lower, a dielectric structure may be used. U.S. Pat. No. 3,414,903 issued to Bartlett et al. on Dec. 3, 1968 for an Antenna System with Dielectric Horn Structure Interposed Between the Source and Lens discloses the use of a dielectric cone to adjust, rather than focus, the radiation pattern of an antenna.

For coaxial antenna connector systems often used on vehicles, a probe feeds the antenna through the mount. Capacitor coupling of the antenna to the feed cable is known in the art as reflected by Alexander, "Capacitive Matching of Microstrip Patch Antennas," IEE Proceedings, Vol. 136, Pt. H, No. 2, April 1989, pp. 172–174. Such capacitive coupling advantageously eliminates the need for tuning posts in such probe fed antennae.

One variation on the patch antenna is known as the Planar Inverted F Antenna or PIFA. Patch and PIFA antennae are compared in Fujimoto and James, *Mobile Antenna Systems Handbook,* Artech House, Boston, 1994, pp. 160–161. A short theoretical development of the PIFA is included in Fujimoto et al., "Small Antennas," Research Studies Press Ltd., Letchworth, England, pp. 127–131.

The PIFA has been investigated for its superior radiation pattern in mobile telephone operation. One such investigative study is Kuboyama et al., "Experimental Results with Mobile Antenna Having Cross-Polarization Components in Urban and Rural Areas," IEEE Transactions on Vehicular Technology, Vol. 39, No. 2, pp. 150–160.

The antenna shown in FIGS. 1 and 2 is typical of such an antenna and has a bandwidth on the order of two percent (2%) of the center frequency. The edge feeding arrangement does not lend itself as readily to flush mounting as a center feed does. One commercial version of this antenna has the further disadvantage of requiring a grounded tuning wire separate from the sheet metal of the radiator.

From the foregoing, it can be seen that while current disk, patch, or PIFA antennae have some advantages, they nevertheless incur some drawbacks which inhibit or hinder their use in conjunction with cellular telephone transmissions. Consequently, in order to achieve an inconspicuous cellular telephone antenna, it would be advantageous to overcome these disadvantages and provide a wider bandwidth through a disk or patch antenna while maintaining the inconspicuous nature of it. FIGS. 1 and 2 show one embodiment of a current patch antenna with a coaxial cable feeding the antenna from one edge.

SUMMARY OF THE INVENTION

The present invention provides low profile or inconspicuous cellular antenna means while enhancing the bandwidth and radiation angle of the transmitted wireless or cellular antenna signal. Bandwidth is increased by notching the edges of the antenna so as to provide additional corners and to increase the perimeter of the antenna. The bandwidth may be improved by notching the edges of the antenna. However, adding a section to the antenna such as that described in the Conroy '976 patent (a ninety degree (90°) radial extension of the disk) proves inadequate for mobile or cellular telephone operations. Additional sections are added to the sides of the radiating rectangle. The sections do not need to protrude more than one-eighth inch (⅛") from the body of the radiator and their exact dimensions are not critical. A wider grounding strap having a width that tunes the antenna replaces the ground wire present in antennae such as are known in the prior art and as shown in FIGS. 1 and 2.

In order to provide antenna operation on one of several adjacent frequency bands, a tuning tab is present that is bent or eliminated in order to tune the antenna. In order to provide a lower radiation angle, a dielectric cover with prismatic edges covers the antenna and serves to redirect the radiated beam. By including such a prismatically edged cover, the radiation angle of the PIFA (Planar Inverted F Antenna) is reduced from approximately forty degrees (40°) to twenty degrees (20°) without increasing the overall height of the packaged antenna. This provides a radiation angle range of seventy degrees (70°) to twenty degrees (20°) above the horizon. A central feed for the antenna package is used while maintaining an edge feed by attaching a coaxial cable to an edge feed point. The coaxial cable travels to the center of the disk, providing central signal access to the base for the antenna package. A strain relief soldered to the lower base plate provides stability for the coaxial cable.

In an alternative embodiment, the PIFA antenna of the present invention may have a mating connector used to attach to interchangeable coaxial connector systems which are standard and known in the industry. The mating connector is located in the center of the base disk and is capacitively coupled to the center conductor of the coaxial cable to conduct the signal to the upper radiating plate of the PIFA antenna. A brass tab serves as the coupling capacitor and is soldered to the top of the center coaxial pin. For a lower profile, the mating connector protrudes up into the body of the antenna requiring a grounding tab be placed at or near the former edge feed point similar to that used in the edge-fed embodiment shown in FIGS. 3 and 4. Some experimentation is necessary in order to achieve optimum dimensions and positions of the foregoing elements. However, such optimization is not needed to put the invention into practice.

Approximately one-quarter inch (¼") of the mating connector is left below the bottom mounting plate. A sheet of plastic foam slightly thicker than the depth of the connector is secured to the underside of the bottom plate. This foam acts as a friction seal when the antenna is screwed onto the mating connector and allows for slight variations in curvature of the mounting surface.

The dimensions of the top plate, the location and width of the edge positioned tuning plates, the area and insulation thickness of the coupling-capacitor, and the dielectric properties of the cover are not by themselves critical. All are interconnected, interdependent, and are best determined by a process of trial and error. No undue experimentation is seen as required. The craft involved is subject to unpredictable material and geometrical constraints. Manufacturing uniformity allows mass production once an optimum construction is determined for the particular central frequency and bandwidth.

By making the bottom conductive plate only slightly larger than the top radiator, an antenna may be constructed whose resonant frequency is independent of ground plane mounting. This antenna may thus be used with no ground plane, although a slight adjustment of the tuning parameters previously described may optimize the operation for one set of operating conditions or another.

OBJECTS OF THE INVENTION

It is an object of the present invention to provide a wide-banded low-profile antenna for cellular telephone communications.

It is an additional object of the present invention to provide a low-profile antenna with superior radiation characteristics for mobile telephone operation.

It is yet another object of the present invention to provide a more easily manufactured low-profile antenna with improved tuning.

It is an additional object of the present invention to provide a low profile antenna with a bandwidth suitable for mobile or cellular communications.

It is yet another object of the present invention to combine such superior radiation characteristics and improved tuning capabilities with an antenna having seven percent (7%) to ten percent (10%) bandwidth required for mobile or cellular telephone operation.

It is a further object of the present invention to provide a low-profile antenna with improved transmission characteristics that can be mounted on a standardized mobile antenna connector.

It is yet another object of the present invention to provide a low-profile antenna with improved transmission characteristics that can be operated with or without a ground plane.

These and other objects and advantages of the present invention will be apparent from a review of the following specification and accompanying drawings.

BRIEF DESCRIPTION OF THE DRAWINGS

FIG. 3 shows a top plan view of a first embodiment of the present invention with its notches, wider ground tab, and centrally fed coaxial cable that leads to an edge feed point on the radiator portion of the antenna.

FIG. 4 shows a side elevational cut-away view taken along line 4—4 of the antenna shown in FIG. 3.

FIG. 5 shows a top plan view of an alternative embodiment of the present invention with the underlying central NMO mount connector and the insulating material shown underneath the top radiator portion in dashed lines.

FIG. 6 shows a first side elevational view taken along line 6—6 of the antenna shown in FIG. 5 with both the ground and tuning tabs shown.

FIG. 7 shows a side elevational cut-away view taken along line 7—7 of the antenna shown in FIG. 5 showing the dielectric between the brass tab connected to the center coaxial pin and the top radiator portion of the antenna.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequence may be accomplished by different embodiments that are also intended to be encompassed within the spirit and scope of the invention.

Figure 1:
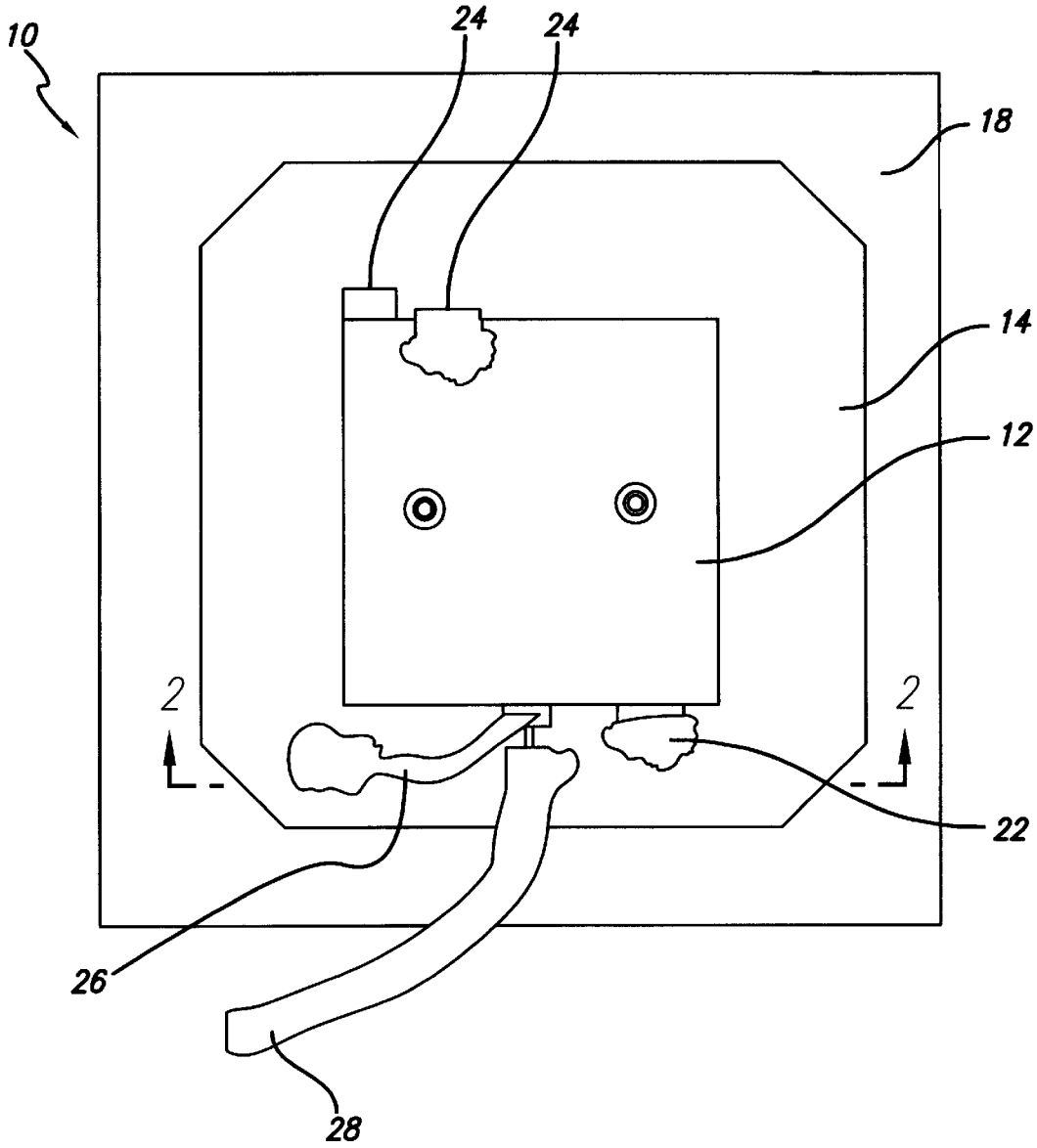
FIG. 1 shows a top view of a known PIFA patch antenna having both a ground tab and a ground wire cut to match impedance.
Figure 2:
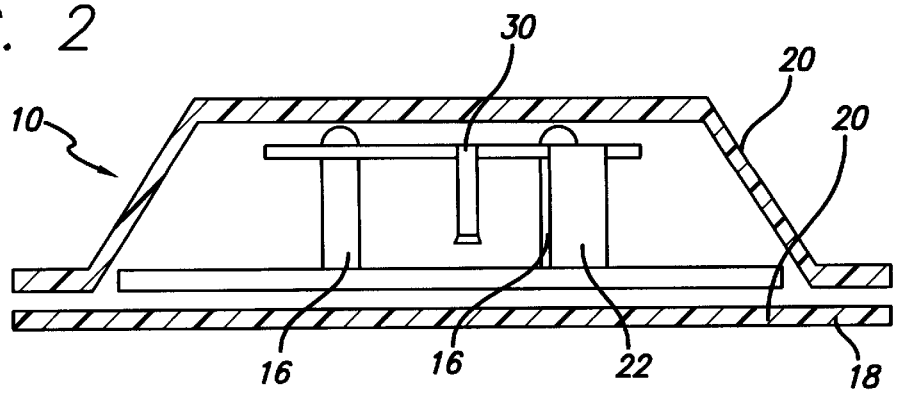
FIG. 2 shows a side elevational cut-away view taken along line 2—2 of the known antenna shown in FIG. 1.

The present invention provides an improved, low profile antenna having better operating characteristics than similar antennae previously known in the art. An example of such prior antennae is shown in FIGS. 1 and 2. Such antennae 10 have a top metal radiator 12 supported above a metal base 14 by standoff insulators 16 made of dielectric or some other similar material. A plastic base plate 18 serves to provide support for the antenna as a whole as part of a thin plastic package 20 providing camouflage and protection from the exterior elements thus preserving the metal components intact. A ground tab 22 serves to ground the top metal radiator 12 to the metal base 14. Tuning tabs 24 allow the antenna to be tuned to specific frequencies. An additional ground wire 26 is cut in length to match the impedance of the antenna with the coaxial cable. The coaxial cable 28 feeds the antenna at a connector tab 30 for the coaxial cable.

While such antennae have their uses, drawbacks include:

1) a relatively narrow bandwidth on the order of two percent (2%) to three percent (3%) of the center frequency. Wireless telephone applications generally require bandwidths more on the order of seven percent (7%) to ten percent (10%);
2) a feed geometry that is difficult to adapt for mobile radio applications where the antenna must be mounted to the vehicle with a standardized connector system;
3) a high radiation angle, on the order of sixty degrees (60°) to ninety degrees (90°) above the horizon when they are mounted on a horizontal surface such as an automobile or other vehicle; and
4) various manufacturing and fabrication difficulties, as the positions of hidden posts must be carefully located.

These drawbacks indicate the need for improvement in the art, as it is most desirable to have an inconspicuous antenna with highly desirable and wide bandwidth transmission and receiving capabilities.

To forward the art in this area, the present invention is shown in alternative embodiments in FIGS. 3 through 7.

In FIGS. 3 and 4, a plastic base 40 supports a metal base 42 over which a metal radiator serving as the antenna 44 is held by dielectric or insulating posts or the like 46. The metal radiator 44 has irregular edges 48 to expand the bandwidth of the antenna. The irregular edges serve to increase the number of corners present on the top metal radiator 44 as well as increasing its perimeter length. A timing tab 50 is present and may be adjusted or removed in order to better tune the antenna to a selected one of adjacent frequencies.

A wider ground tab 52 eliminates the ground wire 26 cut to match impedance present in the prior art antenna shown in FIG. 1. The coaxial feed point 54 is at one side of the top metal radiator centrally located between two adjacent sides. However, the location of the feed point 54 may be adjusted according to desired antenna response characteristics. A coaxial cable 56 serves to feed the transmission signal to the antenna 58 shown in FIGS. 3 and 4.

As shown in FIG. 4, a plastic package with thick side walls covers and protects the antenna 58. The plastic package, particularly the top cover thereof, 62 may be made of dielectric or the like and has or incorporates prisms 64 at the edges in order to redirect the radiation pattern. In one such embodiment, prisms included in the decorative cover lowered the radiation angle of the PIFA antenna 58 shown in FIGS. 3 and 4 from forty degrees (40°) to twenty degrees (20°) without increasing the height of the overall antenna 58 with its package 60. As disk, or patch, antenna generally have a high radiation angle of sixty degrees (60°) to ninety degrees (90°), the prisms 64 serve to provide a radiation angle in the antenna 58 in a range of approximately seventy degrees (70°) to twenty degrees (20°) from the horizon. A foam layer having adhesive on both sides 66 may serve as a cushion or contact in conjunction with the plastic base 40. The foam layer 66 may serve to seal the antenna 58 within the plastic package 60.

In FIGS. 5 through 7, an alternative embodiment of the present invention is shown in an NMO mount PIFA antenna 100. A notched metal radiator 102 serves as the top antenna radiating portion. A metal base 104 is spaced away and below the top metal radiator 102. A plastic base 106 serves to support the metal base 104. A ground tab 108 serves to electrically connect the top metal radiator 102 with the lower metal base 104. A tuning tab (similar to the tuning tab 50 as shown in FIG. 3) is present to allow tuning of the antenna to a selected one of adjacent frequencies. A coaxial connector 120, meant to closely engage corresponding portions of antenna feed mounts known in the art, is centrally attached and protrudes through the plastic base 106. A foam spacer ring 122 having adhesive on top to connect it to the bottom portion of the plastic base 106 circumscribes the coaxial connector 120 while being flush with the sides of the plastic package 124 that protect and optically obscure the antenna 100.

The central pin 130 protrudes from the connector 120 into the antenna cavity defined by the plastic package 124. The central coaxial pin 130 is connected to a metal tab 132 to transmit the signals impressed upon the central pin 130. A dielectric 134 enhances the capacitance between the top metal radiator 102 and the metal tab 132 connected to the center coaxial pin 130.

Apparently due to the combination of the conductive mass protruding into the antenna 58 and the capacitive coupling, a second grounding tab 110 is present and is placed at or near the former feed point of the edge-fed version (FIGS. 3 and 4) of the present invention.

As for the embodiment shown in FIGS. 3 and 4, a prismatic dielectric cover serves to lower the radiation angle of the PIFA antenna from forty degrees (40°) to twenty degrees (20°) (to provide an operating radiation angle of approximately seventy degrees (70°) to twenty degrees (20°)) without increasing the overall height or prominence of the low-profile antenna 100.

While the present invention has been described with regards to particular embodiments, it is recognized that additional variations of the present invention may be devised without departing from the inventive concept.

What is claimed is:

1. A low profile antenna, comprising:

a baseplate;

a radiator, said radiator held proximate said baseplate generally parallel to said baseplate;

said radiator having a series of irregular edges and notches about a perimeter of said radiator, said perimeter being generally square and flared outwardly and forwardly on an end, said end flared outwardly in a manner resembling a first overlaid rectangle extending across said radiator at said end, said end flared forwardly in a manner resembling second and third adjoining rectangles, said second rectangle being smaller than and adjacent to said first rectangle, said second rectangle projecting outwardly from a side of said first rectangle, said third rectangle being smaller than and adjacent to said second rectangle, said third rectangle projecting outwardly from a side of said second rectangle opposite to that of said first rectangle, said irregular edges broadening a bandwidth of the antenna; and a wide ground tab having a width, said wide ground tab connecting said radiator and said baseplate and tuning the antenna according to said width; whereby a tunable low profile antenna is provided having a broadened bandwidth suitable for mobile and cellular telephone operation.

2. The low profile antenna of claim 1, wherein said baseplate is slightly larger than said radiator; whereby a resonant frequency of the antenna is independent of ground plane mounting.

3. The low profile antenna of claim 1, further comprising:

a tuning tab, said tuning tab adjustably tuning the antenna.

4. The low profile antenna of claim 3, wherein said tuning tab is present adjacent said irregular edges.

5. The low profile antenna of claim 1, further comprising:

a dielectric cover, said dielectric cover covering said radiator, said dielectric cover lowering a radiation angle of the antenna; whereby the antenna radiates more effectively for better reception and transmission.

6. The low profile antenna of claim 5, further comprising:

prisms, said prisms incorporated into said dielectric cover, said prisms refracting radiation to and from the antenna to provide said lower radiation angle.

7. The low profile antenna of claim 5, wherein said dielectric cover is decorative, including camouflaging, in nature.

8. The low profile antenna of claim 6, wherein said dielectric cover lowers said radiation angle approximately forty degrees (40°) to twenty degrees (20°).

9. The low profile antenna of claim 8, wherein said radiation angle is lowered without raising a height of the antenna, thereby allowing the antenna to maintain a low profile accompanied with a low radiation angle.

10. The low profile antenna of claim 1, further comprising:

an insulating mounting plate;

said baseplate mounted on said insulating mounting plate;

an edge feed point connected to said radiator; and a coaxial cable, said coaxial cable passing through a central portion of said insulating mounting plate and one line of said coaxial cable connected to said edge feed point; whereby the antenna is centrally fed by said coaxial cable.

11. A low profile antenna, comprising:

a baseplate;

a radiator, said radiator slightly smaller than said baseplate so that a resonant frequency of the antenna is independent of a ground plane mounting, said radiator held proximate and generally parallel to said baseplate;

said radiator having a series of irregular edges and notches about a perimeter of said radiator, said perimeter being generally square and flared outwardly and forwardly on an end, said end flared outwardly in a manner resembling a first overlaid rectangle extending across said radiator at said end, said end flared forwardly in a manner resembling second and third adjoining rectangles, said second rectangle being smaller than and adjacent to said first rectangle, said second rectangle projecting outwardly from a side of said first rectangle, said third rectangle being smaller than and adjacent to said second rectangle, said third rectangle projecting outwardly from a side of said second rectangle opposite to that of said first rectangle, said irregular edges broadening a bandwidth of the antenna;

a wide ground tab having a width, said wide ground tab connecting said radiator and said baseplate and tuning the antenna according to said width;

a tuning tab, said tuning tab present adjacent said irregular edges and adjustably tuning the antenna;

a prismatic dielectric cover, said prismatic dielectric cover covering said radiator, said prismatic dielectric cover refracting radiation passing through it and lowering a radiation angle of the antenna approximately forty degrees (40°) to twenty degrees (20°) so that the antenna radiates more effectively for better reception and transmission, said radiation angle lowered without raising a height of the antenna, thereby allowing the antenna to maintain a low profile accompanied with a low radiation angle, said prismatic dielectric cover being decorative, including camouflaging, in nature;

an insulating mounting plate;

said baseplate mounted on said insulating mounting plate;

an edge feed point connected to said radiator; and a coaxial cable, said coaxial cable passing through a central portion of said insulating mounting plate and one line of said coaxial cable connected to said edge feed point so that the antenna may be centrally fed by said coaxial cable; whereby a tunable low profile antenna is provided having a broadened bandwidth suitable for mobile and cellular telephone operation.

12. A low profile antenna, comprising:

a baseplate;

a radiator, said radiator held proximate said baseplate generally parallel to said baseplate;

said radiator having a series of irregular edges or notches about a perimeter of said radiator, said perimeter being generally square and flared outwardly and forwardly on an end, said end flared outwardly in a manner resembling a first overlaid rectangle extending across said radiator at said end, said end flared forwardly in a manner resembling second and third adjoining rectangles, said second rectangle being smaller than and adjacent to said first rectangle, said second rectangle projecting outwardly from a side of said first rectangle, said third rectangle being smaller than and adjacent to said second rectangle, said third rectangle projecting outwardly from a side of said second rectangle opposite to that of said first rectangle, said irregular edges broadening a bandwidth of the antenna;

a first wide grounding tab having a width, said first wide grounding tab connecting said radiator and said baseplate and tuning the antenna according to said width; and a coaxial connector system coupled to said baseplate and allowing antennas to be interchanged; whereby a tunable low profile antenna is provided having a broadened bandwidth suitable for mobile and cellular telephone operation that is easily interchangeable with other antennas due to said coaxial connector system.

13. The low profile antenna of claim 12, wherein said coaxial connector system is capacitively coupled to said radiator.

14. The low profile antenna of claim 13, further comprising:

a center pin, said center pin coupled to said coaxial connector system;

a tab defining a tab area, said tab coupled to said center pin and conducting signals upon said center pin;

insulating material, said insulating material separating said tab and said radiator; and a second grounding tab, said second grounding tab positioned in a location approximately the same as an edge feed would be placed on the antenna; whereby said capacitive coupling is achieved by capacitance present between said tab and said radiator.

15. The low profile antenna of claim 14, wherein said tab and said capacitive coupling accompanying said tab are off center of said radiator.

16. The low profile antenna of claim 15, wherein tuning of the antenna is achieved by adjusting said tab area and/or thickness of said insulating material until a desired resonance is achieved.

17. The low profile antenna of claim 13, wherein said baseplate is slightly larger than said radiator; whereby a resonant frequency of the antenna is independent of ground plane mounting.

18. A low profile antenna, comprising:

a baseplate;

a radiator, said radiator held proximate said baseplate generally parallel to said baseplate;

said radiator having a series of irregular edges or notches about a perimeter of said radiator, said perimeter being generally square and flared outwardly and forwardly on an end, said end flared outwardly in a manner resembling a first overlaid rectangle extending across said radiator at said end, said end flared forwardly in a manner resembling second and third adjoining rectangles, said second rectangle being smaller than and adjacent to said first rectangle, said second rectangle projecting outwardly from a side of said first rectangle, said third rectangle being smaller than and adjacent to said second rectangle, said third rectangle projecting outwardly from a side of said second rectangle opposite to that of said first rectangle, said irregular edges broadening a bandwidth of the antenna;

a first wide grounding tab having a width, said first wide grounding tab connecting said radiator and said baseplate and tuning the antenna according to said width;

a coaxial connector system coupled to said baseplate and allowing antennas to be interchanged, said coaxial connector system capacitively coupled to said radiator;

a center pin, said center pin coupled to said coaxial connector system;

a tab defining a tab area, said tab coupled to said center pin and conducting signals upon said center pin, said tab adjacent said radiator so that said capacitive coupling is achieved by capacitance present between said tab and said radiator, said tab and said capacitive coupling accompanying said tab off center of said radiator;

insulating material, said insulating material separating said tab and said radiator; and a second grounding tab, said second grounding tab connecting said radiator and said baseplate, said second grounding tab positioned in a location approximately the same as an edge feed would be placed on the antenna; whereby a tunable low profile antenna is provided having a broadened bandwidth suitable for mobile and cellular telephone operation that is easily interchangeable with other antennas due to said coaxial connector system.

19. The low profile antenna of claim 18, wherein tuning of the antenna is achieved by adjusting said tab area and/or thickness of said insulating material until a desired resonance is achieved.

20. The low profile antenna of claim 18, wherein said baseplate is slightly larger than said radiator; whereby a resonant frequency of the antenna is independent of ground plane mounting.

* * * * *